US006043834A

United States Patent [19]

Torisawa

[11] Patent Number: 6,043,834

[45] Date of Patent: Mar. 28, 2000

[54] PACKAGE OF THERMAL RECORDING SHEETS AND A THERMAL IMAGE RECORDING APPARATUS EMPLOYING THE PACKAGE

[75] Inventor: Nobuyuki Torisawa, Minami-ashigara, Japan

[73] Assignee: Fuji Photo Film Co., Ltd., Kanagawa, Japan

[21] Appl. No.: 08/744,324

[22] Filed: Nov. 7, 1996

[30] Foreign Application Priority Data

Jul. 11, 1995 [JP] Japan ..... 7-289016

[51] Int. Cl.[7] ..... B41J 29/17

[52] U.S. Cl. ..... 347/218

[58] Field of Search ..... 347/218, 171, 347/33; 400/701, 702; 29/17

[56] References Cited

U.S. PATENT DOCUMENTS

| | | | |
|---|---|---|---|
| 4,947,190 | 8/1990 | Mizusawa et al. | 347/33 |
| 5,227,844 | 7/1993 | Bhattacharjee et al. | 355/215 |
| 5,563,646 | 10/1996 | Fukuda | 347/171 |

FOREIGN PATENT DOCUMENTS

| | | | |
|---|---|---|---|
| 0 531 992 | 3/1993 | European Pat. Off. | B41J 29/17 |
| 0 581 344 | 2/1994 | European Pat. Off. | B41J 2/165 |
| 8809610 | 11/1988 | Germany | G88C 9/610 |
| 2 238 510 | 6/1991 | United Kingdom | B41J 2/165 |
| 92/04990 | 4/1992 | WIPO | B08B 1/02 |

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

The improved package of thermal recording sheets of the invention is wrapped as a stack which contains at least one maintenance sheet in addition to the thermal recording sheets. The improved thermal image recording apparatus of the invention uses the improved package, detects directly or indirectly that the next sheet is the maintenance sheet by a detection sensor and allows the first or detected maintenance sheet to be carried to a recording section by a transport device and a treatment associated with the maintenance sheet to perform in the recording section by a control device. Other improved apparatus of the invention is provided with a maintenance sheet magazine for accommodating maintenance sheets and allow the treatment to perform at the recording section in the same manner. Therefore, the improved package and apparatus permit the thermal head to be cleaned periodically in an automatic fashion. As a result, the thermal head can be maintained in a sufficiently good condition to ensure consistent thermal recording to produce high-quality images.

4 Claims, 3 Drawing Sheets

PACKAGE OF THERMAL RECORDING SHEETS AND A THERMAL IMAGE RECORDING APPARATUS EMPLOYING THE PACKAGE

BACKGROUND OF THE INVENTION

This invention relates to the art of recording images on thermal recording materials. More particularly, this invention relates to a package of thermal recording sheets containing at least one maintenance sheet for use in thermal head cleaning and a thermal image recording apparatus capable of cleaning a thermal head employing the maintenance sheet.

Thermal recording materials are commonly used to record the images produced in diagnosis by ultrasonic scanning. This recording method, commonly referred to as thermal image recording, eliminates the need for wet processing and offers several advantages including convenience in handling. Hence, the use of the thermal image recording system is not limited to small-scale applications such as diagnosis by ultrasonic scanning and an extension to those areas of medical diagnoses such as MRI and X-ray photography where large and high-quality images are required is under review.

As is well known, thermal image recording involves the use of a thermal head having a glaze in which thermal recording dots for heating a thermal recording material to record an image are arranged in one direction and, with the glaze in contact with the thermal recording material, the two members are moved relative to each other in a direction perpendicular to the direction in which the recording dots are arranged, as said dots are heated imagewise in accordance with the image to be recorded to heat the thermal recording layer, thereby accomplishing image reproduction.

Thus, the thermal head is kept in contact with the thermal recording material while image reproduction is performed and it is not uncommon that the temperature of the thermal head (glaze) reaches at least 200° C. or more even in the normal recording mode. As a result, the fine dust particles depositing on the thermal recording material and the recording material itself will fuse, burn or undergo other thermal deterioration that increases the chance of thermal head staining. To remove the stain, the glaze surface and other areas of thermal head need be cleaned periodically.

With the prior art thermal recording apparatus, cleaning of the thermal head is a cumbersome and time-consuming work because the operator has to remove the stain on the glaze surface and other areas of the thermal head manually using a suitable means such as a cloth wetted with a liquid cleaner such as alcohol or a lapping sheet having a fine enough mesh and this is one of the causes of reduced efficiency in image reproduction. In addition, cleaning with the lapping sheet is essentially a process that polishes the glaze surface and if it is accomplished manually, irregularities may sometimes develop on the glaze surface.

What is more, the structural design of the thermal recording apparatus is such that the operational efficiency of cleaning the thermal head is low and it must sometimes be removed from the apparatus before it is cleaned.

A further problem with the prior art thermal recording apparatus is that the operator often forgets to clean the thermal head, so that the staining of the head aggravates until it fouls the recorded image. The irregularities on the glaze surface can be a cause of the production of defective images. Such image stain and defects not only result in the deterioration of the quality of finished images; they can also cause a serious problem in medical areas by leading to a wrong diagnosis.

SUMMARY OF THE INVENTION

The present invention has been accomplished under these circumstances and has as an object providing a package of thermal recording sheets for use in thermal image recording that enables a thermal head to be cleaned periodically in a simple and rapid manner and which yet ensures that the glaze surface of the thermal head will wear uniformly.

Another object of the invention is to provide a thermal image recording apparatus employing the package.

In order to attain the object described above, the first aspect of the present invention provides a package of thermal recording sheets wrapped as a stack which contains at least one maintenance sheet in addition to the thermal recording sheets.

In order to attain another object described above, the second aspect of the invention provides a thermal image recording apparatus using the package of thermal recording sheets described above, wherein the maintenance sheet is positioned as the first sheet to be used, the apparatus comprising:

a magazine for accommodating the package of thermal recording sheets or the stack of the thermal recording sheets as taken out of the package;

a loading section where the magazine is to be loaded in a predetermined position;

a recording section for performing thermal image recording on a thermal recording sheet;

transport means for taking the thermal recording sheet or the maintenance sheet out of the magazine and transporting it to the recording section;

detection means for sensing that there are no sheets left within the magazine; and control means which, when the magazine that has been found to contain no more sheets as the result of sensing by the detection means is removed from the loading section and subsequently replaced by a new magazine that contains the maintenance sheet as the first sheet to be used and which is loaded in the loading section, allows the first sheet to be carried to the recording section by the transport means such that a treatment associated with the maintenance sheet in the new package is performed in the recording section.

The third aspect of the invention provides a thermal image recording apparatus using the package of thermal recording sheets described above, which comprises:

a magazine for accommodating said package of thermal recording sheets or the stack of thermal recording sheets as taken out of the package;

a loading section where said magazine is to be loaded in a predetermined position;

a recording section for performing thermal image recording on a thermal recording sheet;

transport means for taking a sheet out of the magazine and transporting it to the recording section;

detection means for sensing that the sheet to be taken out next from the magazine is the maintenance sheet; and control means which, when the maintenance sheet has been detected by the detection means, allows the maintenance sheet to be carried to the recording section by the transport means such that a treatment associated with the maintenance sheet is performed in the recording section.

The forth aspect of the invention provides a thermal image recording apparatus comprising:

a recording sheet magazine for accommodating thermal recording sheets;

a maintenance sheet magazine for accommodating maintenance sheets;

a recording sheet magazine loading section where the recording sheet magazine is to be loaded in a predetermined position;

a maintenance sheet magazine loading section where the maintenance sheet magazine is to be loaded in a predetermined position;

a recording section for performing thermal image recording on the thermal recording sheet;

recording sheet transport means for taking the thermal recording sheet out of said recording sheet magazine and transporting it to said recording section;

maintenance sheet transport means which, when a predetermined number of image recording cycles have been performed or in response to the operator's instruction, takes the maintenance sheet out of the maintenance sheet magazine and carries it to the recording sheet transport means; and control means which, when the maintenance sheet has been carried to the recording sheet transport means by the maintenance sheet transport means, allows the maintenance sheet to be carried to the recording section by the recording sheet transport means such that a treatment associated with the maintenance sheet is performed in the recording section.

DETAILED DESCRIPTION OF THE INVENTION

The package of thermal recording sheets and the thermal image recording apparatus of the invention will now be described in detail with reference to the preferred embodiments shown in the accompanying drawings.

Figure 1:
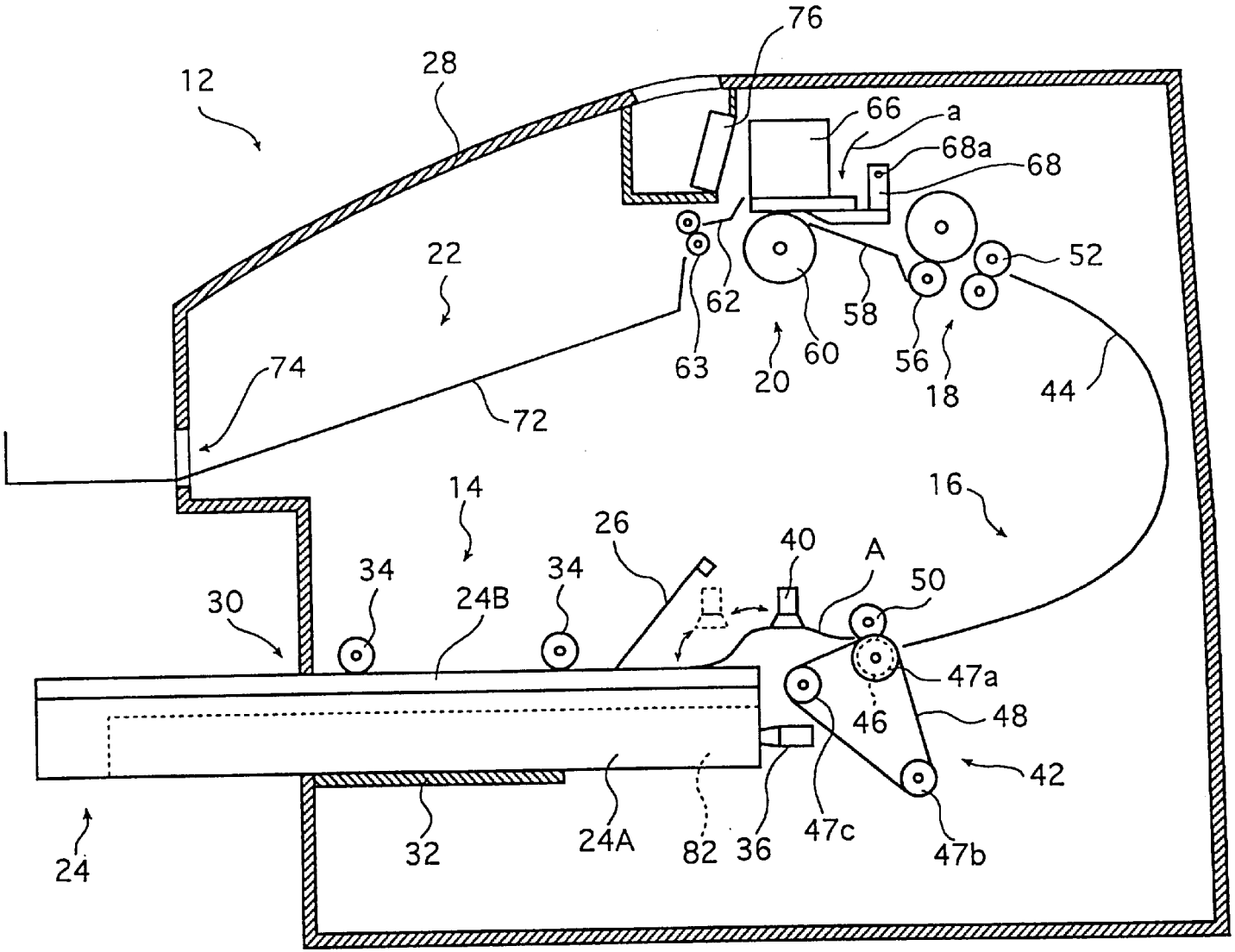
FIG. 1 shows the concept of a thermal image recording apparatus according to an embodiment of the second aspect of the invention, with which the invention package of thermal recording sheets may be employed.

FIG. 1 shows schematically a thermal image recording apparatus of the invention that uses the invention package of thermal recording sheets. The thermal image recording apparatus generally indicated by 12 in FIG. 1 and which is hereunder simply referred to as a "recording apparatus" performs thermal image recording on thermal recording sheets of a given size, say, B4 (namely, thermal recording films in the form of cut sheets, which are hereunder referred to as "thermal sheets A") by means of a thermal head 66. The apparatus comprises a loading section 14 where an invention magazine 24 containing thermal sheets A taken out from an invention package 10 (see FIG. 2) of thermal recording sheets (hereunder simply referred to as a "package") is loaded, a feed/transport section 16, a record/transport section 18, a recording section 20 containing the thermal head 66, and an ejecting section 22.

Figure 2:
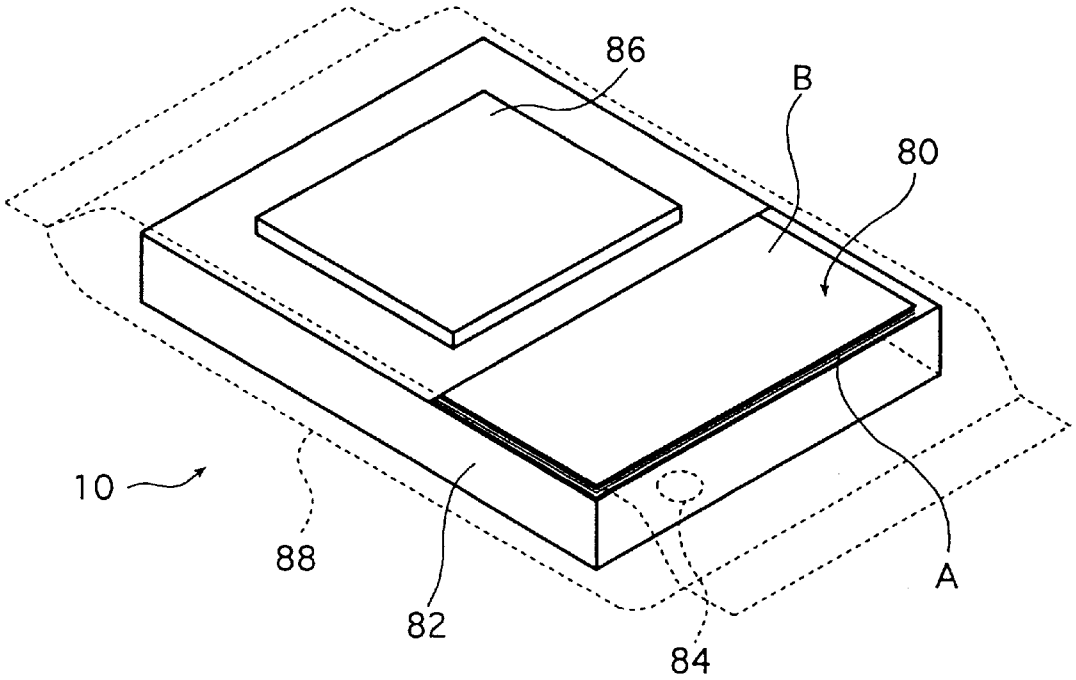
FIG. 2 is a perspective view showing schematically a package of thermal recording sheets according to an embodiment of the first aspect of the invention.

We will first describe in detail the package of thermal recording sheets in accordance with the first aspect of the invention with reference to FIG. 2. The thermal sheets A for use with the recording apparatus 12 each comprises a base film typically made of polyethylene terephthalate (PET) and which is overlaid with a thermal recording layer. Typically, such thermal sheets A are stacked in a specified number, say, 100 to form a bundle, which is either wrapped in a bag or bound with a band to provide a package. The package 10 of the invention which is employed with the recording apparatus 12 contains at least one maintenance sheet in the stack of the recording sheets A.

FIG. 2 is a perspective view showing schematically the thus prepared package 10 of the invention. As shown, the package 10 is that the specified number of thermal sheets A bundled together with the recording side facing down and put into a case 82 typically made of a resin such as polypropylene or cardboard, with a sheet takeout opening 80 formed in a selected area of the top are wrapped in a moisture-resistant bag 88.

The package 10 that can be inserted into the recording apparatus 12 has the maintenance sheet positioned in the topmost part of the stack as the first sheet to be recovered from the package 10. In the illustrated example, sheet B for cleaning the thermal head 66 (i.e., its glaze surface) is positioned as the maintenance sheet with the cleaning side facing down.

The case 82 has a through-hole 84 formed in the position that corresponds to a sucker 40 (see FIGS. 1 and 3) provided as a sheet-feeding mechanism to grab the thermal sheet A and take it out of the case 82. The through-hole 84 is provided to detect the fact that there are no more sheets left within the case 82 (magazine 24). Details of the function of this hole will be given hereunder. A humidity control agent 86 for controlling the humidity is securely attached to the top surface of the case 82.

Prior to use, the package 10 is sealed within a moisture-resistant bag 88. When in use, the case 82 containing the bundled thermal sheets A is taken out of the moisture-resistant bag 88 and put into the magazine 24.

The cleaning sheet B may be exemplified by sheets of various known cleaners used to clean the thermal head 66, such as a "lapping sheet" having fine grains of about 1000 mesh formed on the cleaning surface.

The maintenance sheet to be used in the invention is in no way limited to the illustrated cleaning sheet B and any other devices that can clean the recording apparatus or detect its normal or abnormal operation may be substituted, as exemplified by a pressure-sensitive sheet for measuring the depressing force of the thermal head 66 and a sheet for cleaning the transport path of the thermal sheet A.

In the illustrated package 10, the first sheet to be picked up is the cleaning sheet B (maintenance sheet); however, this is not the sole example of the invention package of thermal recording sheets and the last sheet to be picked up may be used as the cleaning sheet B. Details of this alternative embodiment will be given later.

As already mentioned, just prior to use, the case 82 (containing the thermal sheets A) of the package 10 is taken out of the moisture-resistant bag 88 and put into the magazine 80.

Figure 3:
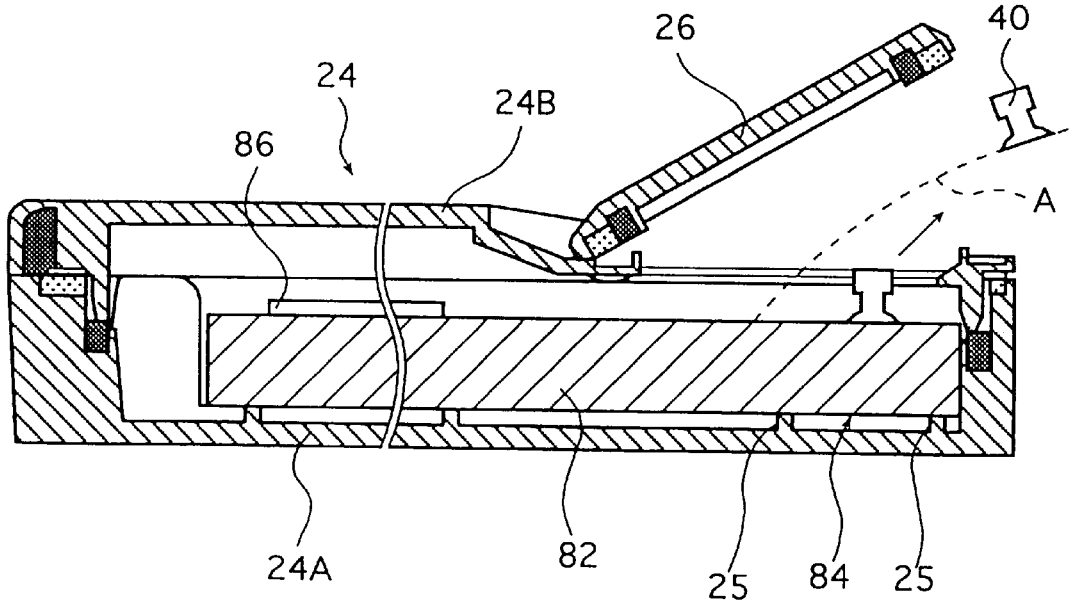
FIG. 3 is a cross section showing schematically an embodiment of a magazine for containing a package of thermal recording sheets that is to be used with the thermal image recording apparatus of FIG. 1.

FIG. 3 shows a schematic cross sectional view of the magazine 24.

The magazine 24 comprises a lower case 24A that is an enclosure or a casing opened over the upper surface and an upper case 24B mounted on the lower case 24A in such a way that overall of the upper open surface of the lower case 24 is closed. Moreover, a cover 26 that can be freely opened and closed is provided over an area corresponding to the sheet takeout opening 80 of the case 82.

The upper and lower cases can be detached from each other and fixed by well known fixing means such as magnets when both cases are assembled.

The thermal sheets A are accommodated within the magazine according to the following procedure. First, the upper case 24B is removed from the lower case 24A, next the case 82 containing the bundled thermal sheets A is accommodated within the lower case 24A, and then the upper case 24B is replaced in position and fixed on the lower case 24A.

In the illustrated example, the case 82 containing the sheets is put into the magazine 24. Alternatively, the stack (or bundle) of thermal sheets A may be taken out of the case 82 and inserted into the magazine 24; therefore, the package of the invention may be free of the case 82.

It should be noted here that the bottom of the lower case 24A is provided with inner ribs 25 such that the case 82 inserted into the magazine 24 (or the thermal sheet at the lowest position of the stack in the absence of the case 82) will not be in intimate contact with the bottom of the lower case 24A.

The magazine 24 which accommodates the case 82 (containing the thermal sheets A) is loaded in the loading section 14 of the recording apparatus 12 (see FIG. 1).

The loading section 14 has an inlet 30 formed in the housing 28 of the recording apparatus 12, a guide plate 32, guide rolls 34 and a stop member 36; the magazine 24 is inserted into the recording apparatus 12 via the inlet 30 in such a way that the portion fitted with the cover 26 is coming first; thereafter, the magazine 24 as it is guided by the guide plate 32 and the guide rolls 34 is pushed until it contacts the stop member 36, whereupon it is loaded at a specified position in the recording apparatus 12.

The feed/transport section 16 has the sheet feeding mechanism using the sucker 40 for grabbing the thermal sheet A by application of suction, transport means 42 and a transport guide 44; the thermal sheets A are taken out of the magazine 24 in the loading section 14 and transported to the record/transport section 18 which is located downstream in the direction of sheet transport.

The transport means 42 is composed of a transport roller 46, a pulley 47*a* coaxial with the roller 46, a pulley 47*b* coupled to a rotating drive source, a tension pulley 47*c*, an endless belt 48 stretched between the three pulleys 47*a*, 47*b* and 47*c*, and a nip roller 50 that is to be pressed onto the transport roller 46. The forward end of the thermal sheet A which has been sheet-fed by means of the sucker 40 is pinched between the transport roller 46 and the nip roller 50 such that the sheet A is transported downstream.

When a signal for the start of recording is issued, the cover 26 is opened by the OPEN/CLOSE mechanism (not shown) in the recording apparatus 12. Then, as shown in FIG. 3, the sheet feeding mechanism using the sucker 40 picks up one sheet of thermal sheet A from the magazine 24 (via the takeout opening 80 in the case 82) and feeds the forward end of the sheet to the transport means 42 (to the nip between rollers 46 and 50) as shown in FIG. 1. The thus fed thermal sheet A is supplied by the transport means 42 into the record/transport section 18 as it is guided by the transport guide 44.

At the point of time when the thermal sheet A has been pinched between the transport roller 46 and the nip roller 50, the sucker 40 releases the sheet and, at the point of time when the thermal sheet A to be used in recording has been completely ejected from the magazine 24, the OPEN/CLOSE mechanism closes the cover 26.

The record/transport section 18 has a regulating roller pair 52, a transport roller pair 56 and a guide 58. The advancing end of the thermal sheet A first reaches the regulating roller pair 52. Therefore, the distance between the transport means 42 and the regulating roller pair 52 which is defined by the transport guide 44 is set to be somewhat shorter than the length of the thermal sheet A in the direction of its transport.

The regulating roller pair 52 are normally at rest. When the advancing end of the thermal sheet A reaches the regulating roller pair 52, the temperature of the thermal head 66 is checked and if it is at a specified level, the regulating roller pair 52 start to transport the thermal sheet A, which is guided by the guide 58 for transport to the recording section 20.

The recording section 20 has the thermal head 66, a platen roller 60, a guide 62 and a fan 76 for cooling the thermal head 66. The thermal head 66 is capable of thermal recording at a recording (pixel) density of, say, about 300 dpi. The head comprises a glazed active device for performing thermal recording on the thermal sheets A and a heat sink fixed to the device. The thermal head 66 is supported on a support member 68 that can pivot about a fulcrum 68a either in the direction of arrow a or in the reverse direction.

Before the thermal sheet A is transported to the recording section 20, the support member 68 has pivoted to UP position (in the direction opposite to the direction of arrow a) so that the thermal head 66 (or its glaze) is not in contact with the platen roller 60. When the advancing end of the thermal sheet A being transported by the record/transport section 18 has reached the record START position (i.e., corresponding to the glaze of the thermal head 66), the support member 68 pivots in the direction of arrow a and the thermal sheet A becomes pinched between the thermal head 66 and the platen roller 60 to be transported downstream as it is held in the specified position by means of the platen roller 60; in the meantime, the thermal head 66 which has the individual recording dots on the glaze heated imagewise performs thermal recording of the original image on the thermal sheet A.

After the end of thermal image recording, the sheet A as it is guided by the guide 62 is transported by the platen roller 60 and a transport roller pair 63 to be ejected into a tray 72 in the ejecting section 22. The tray 72 projects exterior to the recording apparatus 12 via the outlet 74 formed in the housing 28 and the thermal sheet A carrying the recorded image is ejected via the outlet 74 for takeout by the operator.

As described hereinabove, the thermal image recording apparatus 12 which is an embodiment of the present invention employs the package 10 of the invention which has the cleaning sheet B positioned as the top layer of the stack in the package.

We now describe the cleaning action of the thermal head 66 in the recording apparatus 12.

Suppose here that the last thermal sheet A in the magazine 24 (or the case 82) has been processed by thermal recording, whereupon the case 82 becomes empty. If a signal for RECORD is issued, the sucker 40 lowers down to grab a thermal sheet A as in the usual recording mode. However, there is no thermal sheet A left in the case 82 and, as mentioned hereinabove, through-hole 84 is formed in the bottom of the case 82 in the position corresponding to the sucker 40 provided to grab the thermal sheet A to take it out of the case and, in addition, ribs 25 are formed on the bottom of the lower case 24A; hence, the suction applied by the sucker 40 fails to reach the specified pressure which would develop if the thermal sheet A were sucked and grabbed by the sucker 40.

Due to this failure of the sucker 40 to apply the required negative pressure, the recording apparatus 12 detects the absence of thermal sheets A within the case 82 and issues the corresponding message by a display, an alarm sound or any other appropriate signal.

The foregoing is not the sole method that can be employed to detect the absence of thermal sheets A in the magazine 24 (or the case 82) and this "zero sheet" detection can be accomplished by any known methods including an optical method utilizing the reflection or transmission of light, a method of detecting the weight of the magazine 24, and a method of detecting the lifting force of the sucker 40.

Another method that can be adopted is to detect the number of records although this method has a potential for counting errors due to the feeding of more than one sheet.

In response to the message signaling the loss of thermal sheets A, the operator unloads the magazine 24 from the loading section 14, substitutes a new package 10, removes the case 82 from within the moisture resisting bag 88, puts it into the magazine 24, and replaces it in the loading section 14.

After this procedure of magazine reloading which consists of detecting the vacancy of the current magazine, unloading it from the loading section 14 and replacing a new magazine in the loading section 14, the control means (not shown) in the recording apparatus 12 allows the thermal head 66 to be cleaned automatically in the following manner. When the magazine 24 containing the new case 82 is replaced in the loading section 14, the cover 26 is opened (see above) and the first sheet in the stack, namely, the cleaning sheet B is picked up from within the magazine 24 by means of the sucker 40 and carried to the record/transport section 18 by the feed/transport means 16.

Subsequently, without checking of the temperature of the thermal head 66, the cleaning sheet B is carried to the recording section 20 by means of the record/transport section 18; when the advancing end of the cleaning sheet B reaches the record START position, the thermal head 66 lowers down as in the case of thermal sheet A until the cleaning sheet B is pinched between the thermal head 66 and the platen roller 60. During the cleaning step, the glaze of the thermal head is not heated at all or heated to a small extent as the cleaning sheet B pinched between the thermal head 66 and the platen roller 60 is carried by the combination of the platen roller 60 with the transport roller pairs 56 and 63, whereupon the glaze of the thermal head 66 is cleaned by the cleaning surface of the sheet B.

Thus, according to the invention, the thermal head 66 can be cleaned periodically in an automatic, rather than manual, fashion and this contributes to a significant improvement in the efficiency of cleaning operations. In addition, the thermal head 66 can be maintained in a sufficiently good condition to ensure consistent thermal recording to produce high-quality images. Even in an emergency, there will be produced no stained or otherwise defective images and this reduces markedly the necessity of performing repeated recording to produce the desired image.

In addition, in order to clean the thermal head 66, the cleaning sheet which is identical to the thermal sheet A is transported in essentially the same manner as in the process of image recording on the thermal sheet A (except for the absence of heat application); not only does this ensure uniform results in cleaning but it also prevents the formation of irregularities on the glaze surface of the thermal head while achieving simultaneous cleaning of the guides and the transport rollers.

The foregoing description of the package 10 assumes the case where the cleaning sheet B is positioned as the topmost layer of the stack in the package. It should, however, be noted that the package of the invention is by no means limited to the illustrated case and the cleaning sheet B (maintenance sheet) may be positioned as the last sheet or an intermediate layer in the stack of thermal sheets A or at specified sites, say, every 20 sheets, depending upon relevant factors such as the frequency of cleaning operations and the structural design of the package.

Prior to the cleaning of the thermal head 66 in the recording apparatus 12 which uses the package 10 containing the cleaning sheet B in the topmost position of the stack, the absence of thermal sheets A in the magazine 24 is first detected, which provides a basis for detection of the subsequently fed sheet as the cleaning sheet B. However, if the (thermal image) recording apparatus of the invention is adapted to employ a package of such a type that the cleaning sheet B is disposed as the last sheet or in other positions remote from the top, the thermal head 66 may be cleaned after confirming by various detection means that the sheet to be subsequently fed or the already supplied sheet is the cleaning sheet B.

The method of detecting the cleaning sheet B is in no way limited and various methods (and various detecting means used in the methods) can be employed, such as an optical method of measuring the light reflectance or transmittance of the sheet, a method of identification based on the weight of the sheet, a method of detecting the surface state of the sheet, a method of providing the cleaning sheet B with a mark that can be detected with the recording apparatus, a method of detecting a difference in the shape of the cleaning sheet B that has an identifying feature such as a nick at the end of the sheet, a method of detecting the stiffness of the sheet, and a method of detecting the sheet thickness.

If the cleaning sheet B is detected by one of these methods (that is, a detecting sensor carrying out the method), the control means (not shown) allows the cleaning sheet B to be transported in essentially the same manner as in the normal thermal image recording with the aforementioned apparatus 12, except that no heat is applied to the sheet by means of the thermal head 66, for cleaning the thermal head 66.

This embodiment and the illustrated recording apparatus 12 share the common feature that the detection of the cleaning sheet B is automatically followed by cleaning of the thermal head 66. If desired, the image recording apparatus of the invention may be adapted such that it signals the operator that the cleaning sheet B is coming next, thereby enabling him to decide on whether the thermal head need be cleaned.

Figure 4:
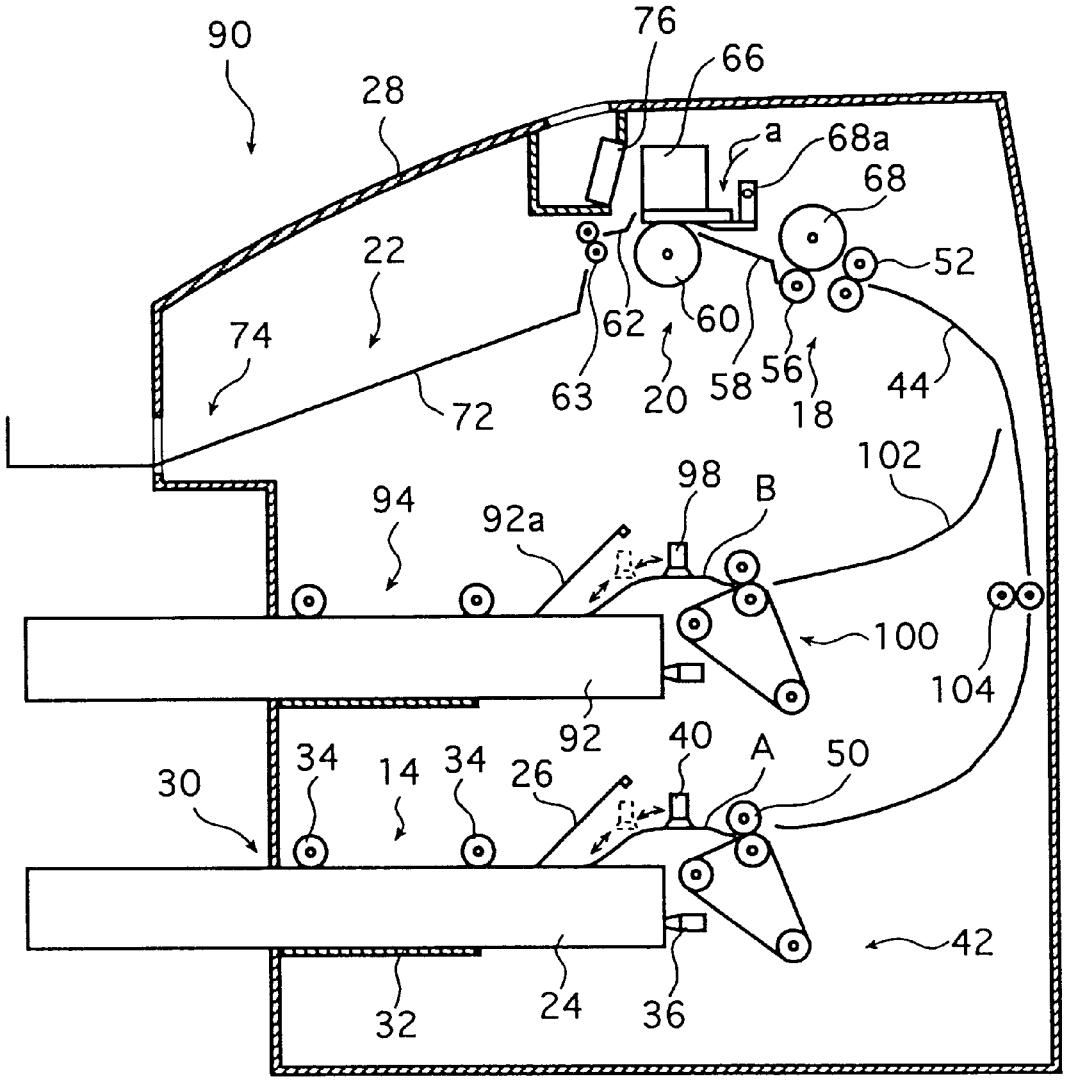
FIG. 4 shows the concept of a thermal image recording apparatus according to an embodiment of the fourth aspect of the invention.

FIG. 4 shows schematically another example of the thermal image recording apparatus of the invention. In the foregoing description, the cleaning sheet B (maintenance sheet) in the packaged stack of thermal sheets A is detected prior to the cleaning of the thermal head 66. This is not the case in the illustrated recording apparatus 90, which contains not only the magazine 24, loading section 14 and transport means 42 which are exclusively used for the thermal sheet A but also a magazine 92, loading section 94 and feed/transport means 96 which are especially provided for the cleaning sheet B. Therefore, the package of thermal sheets which is to be used in the recording apparatus 90 need not be the invention package which contains the cleaning sheet B but may be of any known type.

The recording apparatus 90 shown in FIG. 4 is essentially of the same design as the aforementioned recording apparatus 12, except that it additionally includes the magazine 92, the loading section 94 and the feed/transport means 96 which are especially adapted to the cleaning sheet B. Hence, like members are identified by like numerals in FIG. 4 and the following description is principally directed to the differences between the two apparatus.

The magazine 92 in the illustrated recording apparatus 90 for accommodating the stack of cleaning sheets B is of the same design as the magazine 24 of thermal sheets A and it is loaded in the loading section 94 of the same design as the loading section 14. The feed/transport means 96 is also of the same design as the transport means 42 and comprises a sheet feeding mechanism using a sucker 98 and transport means 100 using an endless belt and any other necessary components. The cleaning sheet B carried by the transport means 100 is guided by a transport guide 102 to be transported to the transport guide 44 for the thermal sheet A and subsequently guided by the transport guide 44 to be forwarded to the record/transport section 18.

In the illustrated recording apparatus 90, the distance from the thermal sheet transport means 42 to the record/transport section 18 is so long that it is necessary to provide a transport roller pair 104 midway of the transport guide 44.

The recording apparatus 90 performs thermal image recording on the thermal sheet A in essentially the same manner as the recording apparatus 12. The thermal head 66 may be cleaned with the sheet B automatically each time image recording has been accomplished on a specified number of thermal sheets A, say, 50 or 100 sheets; alternatively, the operator may decide by himself as to whether the cleaning of the thermal head should be done; if desired, the two approaches may be employed in combination.

If image recording has been accomplished on a predetermined number of thermal sheets or if the operator issues an instruction to clean the thermal head, the OPEN/CLOSE mechanism (not shown) is actuated as in the image recording on thermal sheets A to open the cover 92*a* of the magazine 9*a*; the sucker 98 then picks up the cleaning sheet B to take it out of the magazine 92; the sheet B is subsequently carried by the transport means 100 as it is guided by the transport guide 102 and thereafter the sheet B is guided by the thermal sheet transport guide 44, thence forwarded to the record/transport section 18.

The subsequent process is essentially the same as in the case of the recording apparatus 12; except for the application of no heat by the thermal head 66, the cleaning sheet B is transported as in the image recording process, thereby accomplishing the cleaning of the thermal head 66.

On the foregoing pages, the package of thermal recording sheets and the thermal image recording apparatus employing the package of the invention have been described in detail but the present invention is in no way limited to the stated embodiments and various improvements and modifications can of course be made without departing from the spirit and scope of the invention.

As described on the foregoing page, the package of thermal recording sheets and the thermal image recording apparatus of the invention permit the thermal head to be cleaned or otherwise serviced periodically in an automatic, rather than manual, fashion and this contributes to a significant improvement in the efficiency of maintenance work. In addition, the thermal head can be maintained in a sufficiently good condition to ensure consistent thermal recording to produce high-quality images. Even in an emergency, there will be produced no stained or otherwise defective images and this reduces markedly the necessity of performing repeated recording to produce the desired image.

In addition, in order to clean the thermal head, the maintenance sheet which is identical to the thermal recording sheet is transported in essentially the same manner as in the image recording process (except for the absence of heat application); not only does this ensure uniform results in the maintenance work but it also prevents the formation of irregularities on the glaze surface of the thermal head.

What is claimed is:

1. A thermal image recording apparatus using a package of thermal recording sheets comprising a stack of thermal recording sheets and at least one maintenance sheet for cleaning a thermal recording head of the thermal image recording apparatus in addition to said thermal recording sheets, wherein said at least one maintenance sheet is positioned as the first sheet to be used, said recording apparatus comprising:

a magazine for holding one of said package of thermal recording sheets and the stack of the thermal recording sheets as taken out of said package;

a loading section where said magazine is to be loaded in a predetermined position;

a recording section for performing thermal image recording on a thermal recording sheet from said thermal recording sheets by means of the thermal recording head;

means for taking out a sheet from said magazine which is one of said thermal recording sheets on which an image is to be recorded and said at least one maintenance sheet out of said magazine;

transport means for transporting said sheet taken out from said magazine to said recording section;

detection means for sensing that there are no sheets left within said magazine; and control means for controlling said transport means and said recording head; and wherein, when said magazine that has been found to contain no more sheets as a result of a sensing by said detection means is removed by an operator from said loading section and subsequently replaced by one of the same magazine and a new magazine that contains one of a new package of thermal recording sheets and a new stack of thermal recording sheets as taken out of said new package, said one of said new package of thermal recording sheets and said new stack of thermal recording sheets having at least one new maintenance sheet as a new first sheet to be used, said control means allows the new first sheet to be carried to said recording section by said transport means so that the thermal recording head which is disposed in said recording section is cleaned by said at least one new maintenance sheet in the package, and said control means controls the thermal recording head so that the thermal recording head is not heated at all during a cleaning of said thermal recording head by said at least one new maintenance sheet.

2. The thermal image recording apparatus according to claim 1, wherein said at least one new maintenance sheet which is the new first sheet to be used is a new thermal recording sheet in said one of the new package of thermal recording sheets and the new stack of thermal recording sheets.

3. A thermal image recording apparatus using a package of thermal recording sheets comprising a stack of thermal recording sheets, comprising:

a magazine for holding one of said package of thermal recording sheets and the stack of the thermal recording sheets as taken out of said package;

a loading section where said magazine is to be loaded in a predetermined position;

a recording section having a thermal recording head, said recording section for performing thermal image recording on a thermal recording sheet from said thermal recording sheets by means of the thermal recording head;

means for taking the thermal recording sheet out of said magazine;

transport means for transporting said thermal recording sheet taken out of said magazine to said recording section; and control means for controlling said transport means and said recording head; and wherein, when at least one of a predetermined number of image recording cycles have been performed and an operator issues an instruction to clean said thermal recording head, said control means allows a next thermal recording sheet as a maintenance sheet to be taken out next from said magazine and to be carried to said recording section by said transport means so that the thermal recording head which is disposed in said recording section is cleaned by said next thermal recording sheet, and said control means controls the thermal recording head so that the thermal recording head is not heated at all during a cleaning of said thermal recording head by said next thermal recording sheet.

4. A thermal image recording apparatus using a package of thermal recording sheets comprising a stack of thermal recording sheets, comprising:

a magazine for holding one of said package of thermal recording sheets and the stack of the thermal recording sheets as taken out of said package;

a loading section where said magazine is to be loaded in a predetermined position;

a recording section having a thermal recording head, said recording section for performing thermal image recording on a thermal recording sheet on which an image is to be recorded from said thermal recording sheets by means of the thermal recording head;

means for taking the thermal recording sheet out of said magazine;

transport means for transporting said thermal recording sheet taken out of said magazine to said recording section;

detection means for sensing that there are no sheets left within said magazine; and control means for controlling said transport means and said recording head; and wherein, when the magazine, that has been found to contain no more sheets as a result of a sensing by said detection means is removed by an operator from said loading section and subsequently replaced by one of the same magazine and a new magazine that contains one of a new package of thermal recording sheets and a new stack of thermal recording sheets as taken out of said new package, said control means allows a first thermal recording sheet which is positioned as a new first sheet to be used in said one of said new package and said new stack to be carried as a maintenance sheet to said recording section by said transport means so that the thermal recording head which is disposed in said recording section is cleaned by said first thermal recording sheet in the package, and said control means controls the thermal recording head so that the thermal recording head is not heated at all during a cleaning of said thermal recording head by said first thermal recording sheet.

* * * * *